US006986231B2

(12) United States Patent
Koszo

(10) Patent No.: US 6,986,231 B2
(45) Date of Patent: Jan. 17, 2006

(54) ARCHITECTURAL COLUMN AND METHOD AND APPARATUS FOR PRODUCTION

(75) Inventor: Nandor Koszo, Shailer Park (AU)

(73) Assignee: Classic Columns Australia Pty Ltd, Springwood (AU)

( * ) Notice: Subject to any disclaimer, the term of this patent is extended or adjusted under 35 U.S.C. 154(b) by 0 days.

(21) Appl. No.: 10/192,938

(22) Filed: Jul. 11, 2002

(65) Prior Publication Data

US 2002/0170264 A1 Nov. 21, 2002

Related U.S. Application Data

(63) Continuation-in-part of application No. PCT/AU01/00025, filed on Jan. 12, 2001.

(30) Foreign Application Priority Data

Jan. 12, 2000 (AU) ..... PQ5056

(51) Int. Cl.

| | |
|---|---|
| ***E04C 3/22*** | (2006.01) |
| ***E04C 5/03*** | (2006.01) |
| ***E04C 5/18*** | (2006.01) |

(52) U.S. Cl. ..... 52/721.4; 52/649.7; 52/726.1; 52/732.3; 52/736.4

(58) Field of Classification Search ..... 52/721.2, 52/721.3, 721.4, 721.5, 726.4, 726.3, 649.1, 52/649.2, 649.3, 248, 721.1, 723.1, 723.2, 52/726.1, 726.5, 730.2, 730.4, 730.5, 732.1, 52/732.2, 732.3, 736.4, 649.6, 649.7, 649.8; 47/45; 249/4.8, 49

See application file for complete search history.

(56) References Cited

U.S. PATENT DOCUMENTS

| | | | | | |
|---|---|---|---|---|---|
| 866,460 | A | * | 9/1907 | Haiss | 52/649.7 |
| 1,031,700 | A | * | 7/1912 | Fleming | 52/649.3 |
| 1,052,990 | A | * | 2/1913 | Zillgitt | 52/155 |
| 1,090,312 | A | * | 3/1914 | Lachman | 52/649.1 |
| 1,210,333 | A | * | 12/1916 | Kyle | 138/151 |
| 2,346,391 | A | * | 4/1944 | Pitou et al. | 114/219 |
| 3,590,547 | A | | 7/1971 | Molyneux et al. | |
| 3,990,480 | A | * | 11/1976 | Borodin et al. | 138/175 |
| 4,897,140 | A | | 1/1990 | Opsvik | |
| 5,438,812 | A | | 8/1995 | Erickson | |
| 5,568,709 | A | | 10/1996 | Steckler | |
| 5,794,795 | A | * | 8/1998 | Stemmons | 211/26 |

FOREIGN PATENT DOCUMENTS

| | | | |
|---|---|---|---|
| AU | 64771/60 | B | 9/1962 |
| AU | 87046/82 | A | 5/1983 |
| DE | 3325252 | A | 2/1984 |
| FR | 2299477 | A | 8/1976 |
| GB | 2231893 | A * | 11/1990 |
| JP | 6280306 | A * | 10/1994 |

OTHER PUBLICATIONS

N/A—Int'l Search Rpt Mar. 28, 2001, ISA: Australian Pat entOffice.

* cited by examiner

*Primary Examiner*—Jonathon Szumny
(74) *Attorney, Agent, or Firm*—McCarter & English, LLP

(57) ABSTRACT

A column comprising courses of building blocks such as bricks is arranged with the long axis of each block parallel to the axis of the column and filled with a substrate such as concrete with an axial structural member. The column may be produced with the aid of a cage including spaced apart hoops or rings used to position blocks during column construction. The cage includes indenters for offsetting some of the blocks in order to form aesthetically pleasing grooving along the finished column.

18 Claims, 17 Drawing Sheets

ARCHITECTURAL COLUMN AND METHOD AND APPARATUS FOR PRODUCTION

This is a continuation in part of International Application No. PCT/AU01/00025, with an international filing date of Jan. 12, 2001, published in English under PCT Article 21(2).

FIELD OF THE INVENTION

This invention relates to columns for buildings. This invention also extends to an apparatus for use in making the columns for buildings and also to a method of making the columns using the apparatus.

This invention relates particularly but not exclusively to an apparatus and method for making building columns for residential homes that exhibit highly aesthetic and stylish features. It will therefore be convenient to hereinafter describe the invention with reference to this example application. However it is to be clearly understood that the invention is capable of broader application.

BACKGROUND OF THE INVENTION

Simulated decorative columns or pillars are well known in the poor art. For example in U.S. Pat. No. 5,568,709 there is described a column comprising an axial member surrounded by a jacket composed of a plurality of wedge shaped elongated rigid foam members. Upon assembling the jacket around the axial member the outer surface of the jacket is sanded to provide a smooth surface and the smooth surface is provided with an overcoating resembling a cut surface of stone. A problem with this system is that the columns are not particularly sturdy or weatherproof, composed as they are of foam, so that their longevity is limited. Furthermore a special manufacturing process is required to produce the columns prior to their transportation to the site where they are to be installed.

Alternatively in U.S. Pat. No. 5,934,035 there is described a modular column of rectangular cross section assembled by overlaying precast brick layers, one on top of the other to form a column. A problem with this column and system of construction is that it is not aesthetically pleasing as the resulting column has an appearance somewhat similar to that of a typical rectangular brick chimney stack.

Traditionally columns have been produced of circular stone cross-sections stacked upon each other. While columns produced by such a method are regarded as being aesthetically pleasing, they are expensive and difficult to construct.

It is an object of the invention to provide a column which overcomes at least some of the problems of those described in the prior art and to provide a useful alternative to known column structures and methods of forming same.

SUMMARY OF THE INVENTION

In the following description and claims the term "block" is to be understood as including any building component suitable for the construction of a column of the type described herein. Accordingly, and without limitation, the term "block" refers at least to a brick, including a glass brick, a tile or a stone slab such as a marble slab. Furthermore the term "wedge" is to be understood to encompass trapezoidal shapes and generally will not taper to a point at one end.

According to a first aspect of the invention there is provided a column including blocks, wherein the longest dimension of each block is arranged parallel to the axis of the column.

Preferably the blocks are formed in courses with one course on top of another.

In one embodiment the courses are of square or rectangular cross section. In another embodiment the courses may include wedge-shaped components positioned alternatively between the blocks in order to form courses of generally circular cross section. Alternatively the column may be comprised entirely of the wedge-shaped components. The wedge-shaped components are typically of the same material as the blocks.

Usually the column has an axial structural member which the courses surround. Typically the interior of the column is filled with a settable material, eg concrete.

The wedge shaped components may be inwardly offset from adjacent blocks in order to form longitudinal channels along the outside of the column. Alternatively the wedge shaped components may be located so that their outer surface is adjacent that of neighbouring blocks thereby forming a column with smooth sides.

If it is desired a render may be applied to the finished column,

The column may further include a base and a head.

The column may have a uniform cross-section along its length. Alternatively it may have a non-uniform cross-section along its length, eg with a tapering profile.

According to a further aspect of the present invention there is provided a column formation apparatus or "cage" for facilitating production of the previously described column including a number of first retaining members interconnected by a number of longitudinal members arranged transversely relative to said first retaining members.

Preferably the first retaining members are rings. Preferably the rings include opening and closing means The opening and closing means are conveniently provided by at least one hinge and flanges which may be secured together, for example by bolting or clipping. Other opening and closing means are also possible however, for example rather than use a hinge a further flange and bolt arrangement could be provided.

Preferably the longitudinal members are comprised of metal rods attached to the rings.

In one form the longitudinal members may be attached to the inner walls of the rings. In that case the longitudinal members may act as indenters during construction of a column by means of the cage. For example, the metal rods could be aluminium or steel rods of square cross section. Alternatively the longitudinal members could be attached to the outer walls of the rings with separate indenters attached around the inner wall of each ring.

The column formation apparatus may include a stabilising means for securing to the axial structural member of the column. Such a means will typically be a metal member extending from a ring to the axial member and boltable or otherwise attachable to the axial member.

In order to form columns of a generally circular cross section the rings will also be circular. Alternatively columns of other cross sections, such as rectangular, may be formed by means of a cage having retaining members of corresponding cross-sections.

Preferably the rings are spaced apart no further than the long dimension of the building components used to produce a column.

In a preferred embodiment the column formation apparatus is configured to allow adjustment of the spacing between rings along the longitudinal members.

Preferably the indenters are also adjustable so that the depth of offset may be varied.

According to yet a further aspect of the invention there is provided a method of forming a column as described above, the method comprising the steps of:

forming closed courses of blocks on top of each other wherein the long dimension of each of the blocks is parallel to the axis of the column to be formed;

upon completion of each course filling the space defined by that course with a substrate such as concrete.

Preferably the method is performed with the aid of a cage as previously described and includes the steps of:

locating the cage in a position where a column is to be formed;

arranging building components such as blocks and/or wedges against the inner limits of the cage, the longest dimension of the building components being orientated parallel to the axis of the column; and mortaring adjacent building components to each other during the arrangement step.

Preferably the step of locating the cage includes locating the cage about an axial structural member for the column by opening the rings and placing the cage around said member.

Alternatively the cage may be lowered over the axial structural member.

The cage may be stabilised by securing it to said structural member.

If the hoops are of a circular shape then the arranging of the building components will include positioning wedges and blocks adjacent each other in order to form courses of generally circular cross section. If the cage is of the type wherein the longitudinal members are fixed to the internal walls of the hoops then the arrangement step will produce longitudinal channels due to indentation of some of the components.

BRIEF DESCRIPTION OF THE DRAWINGS

An apparatus for making building columns in accordance with the invention and the columns produced thereby may manifest themselves in a variety of forms. It will be convenient to hereinafter describe in detail several preferred embodiments of the invention with reference to the accompanying drawings. The purpose of providing this detailed description is to instruct persons having an interest in the subject matter of the invention how to carry the invention into practical effect. It will be clearly understood that the specific nature of this detailed description does not supersede the generality of the preceding broad description. In the drawings.

DETAILED DESCRIPTION OF PREFERRED EMBODIMENTS

Figure 1:
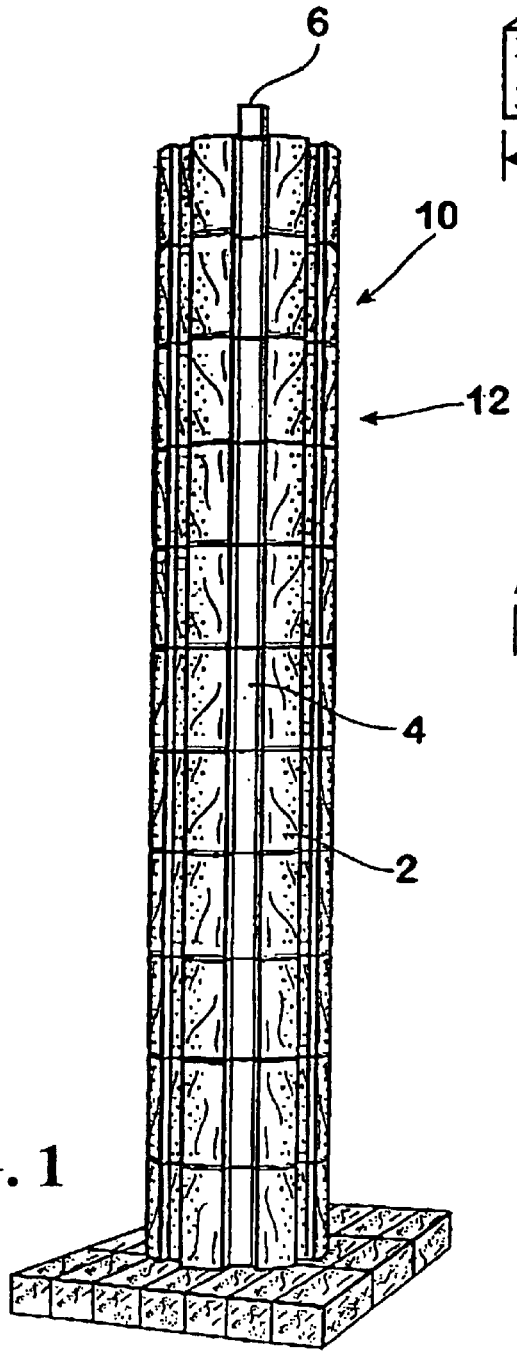
FIG. 1 is a perspective view of a column formed in accordance with the present invention.

Referring now to FIG. 1, there is depicted a column indicated generally by the reference numeral 10.

Figure 2:
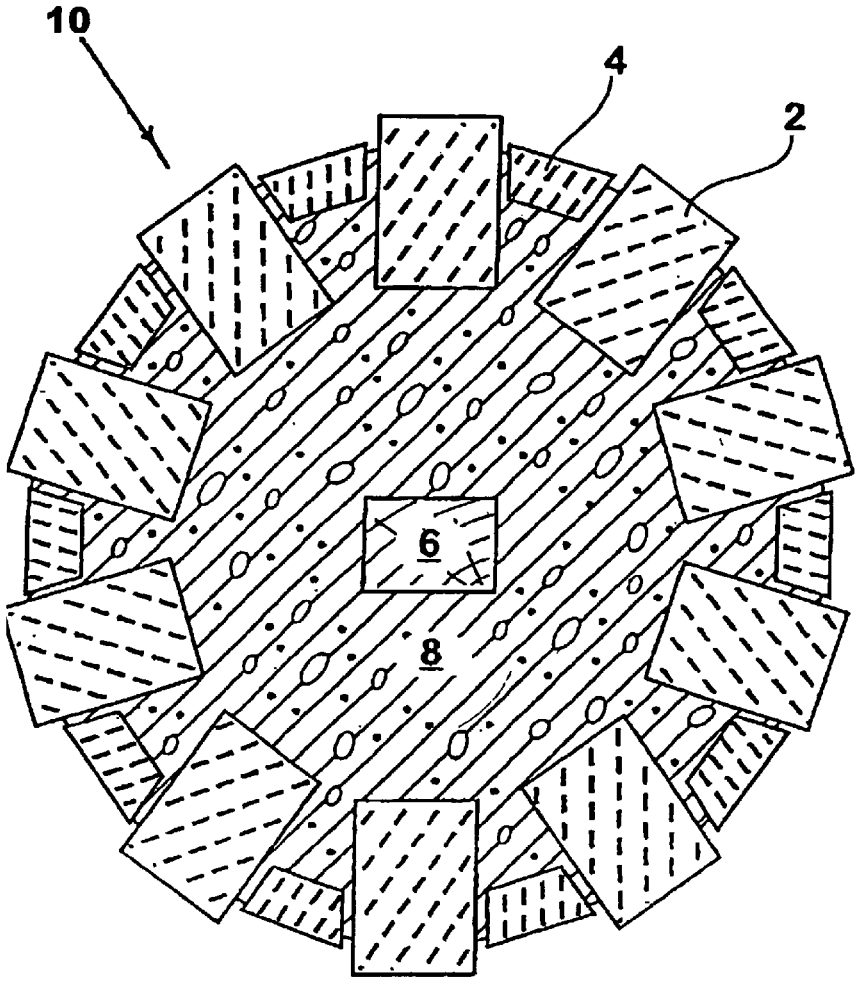
FIG. 2 is a cross-section through a column similar to that of FIG. 1 and in accordance with the present invention.

Column 10 is composed of a number of courses of blocks on top of each other with their long dimensions vertical and parallel to the longitudinal axis of the column. FIG. 2 shows a plan view of a single course 12. It will be noted that between rectangular blocks 2 are wedge blocks 4 formed by cutting square rectangular standard blocks in the appropriate fashion. For example ceramic bricks may be cut with a diamond-saw, so that they have a trapezoidal cross-section.

A building material which is particularly convenient to use in the formation of columns of the type discussed herein is Autoclaved Aerated Concrete such is as available under the trade mark HEBEL manufactured in Australia by CSR Limited of 9 Help Street Chatswood, NSW 2067, Australia. This material is considerably lighter than bricks or other masonry material.

An axial steel structural member 6 that is centrally positioned extends through the column.

Typically about 10 mm of mortar separates the wedges 4 from the adjacent blocks 2. The interior of the course is filled with a settable material which is concrete 8. In the embodiment of FIG. 2 the wedges 4 are offset radially inwardly from the blocks thereby producing decorative vertical channels in the finished column 10. As will be explained, the courses may also be formed without this offset so that the finished column would not include the vertical channels but would have a smoothly curving outer surface.

Figure 3:
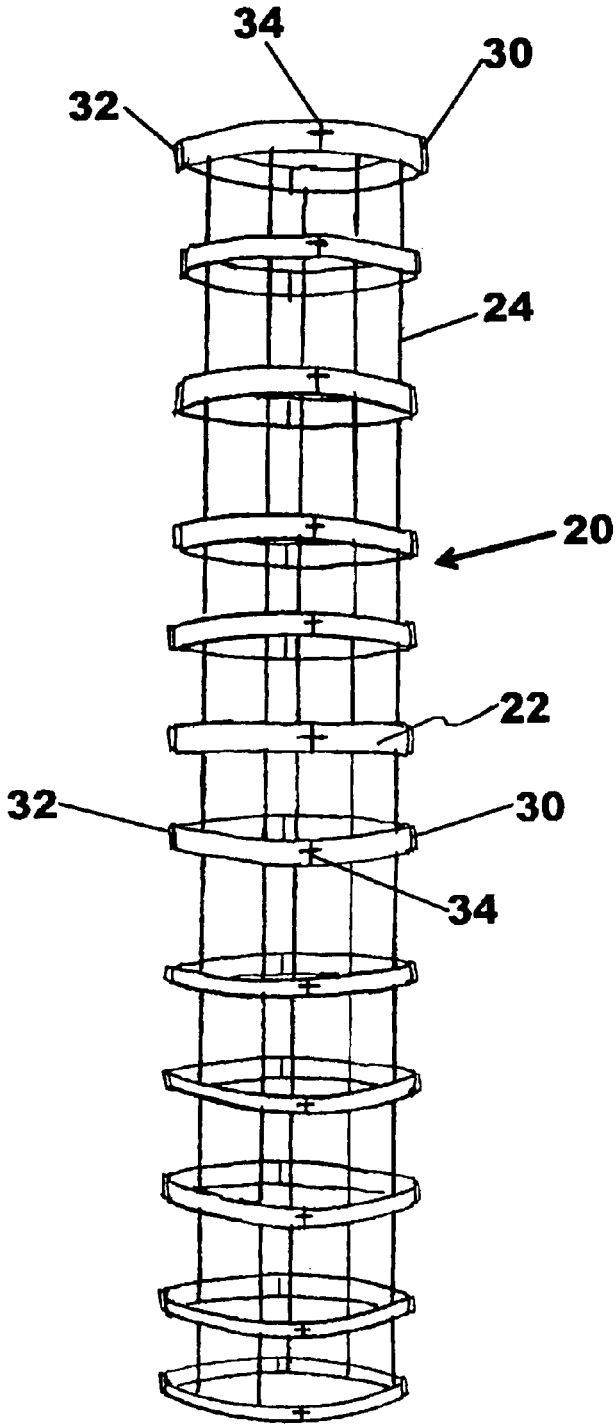
FIG. 3 is a simplified perspective view of a cage in accordance with a first embodiment of the invention used in the production of the column of FIG. 1 in which for ease of clarity some of the longitudinal members have been omitted.

Referring now to FIG. 3 there is shown an apparatus or "cage" 20 for forming the column of FIG. 1. Cage 20 comprises a number of rings 22 supported by a plurality of longitudinal members 24. Apart from the top and bottom rings the ring spacing corresponds to the height of each course of column 10, that is the dimension "B" of the blocks and wedges shown in FIGS. 1A and 1B. The top and bottom rings of cage 10 are located closer to their neighbouring rings as will be explained further shortly.

Figure 4:
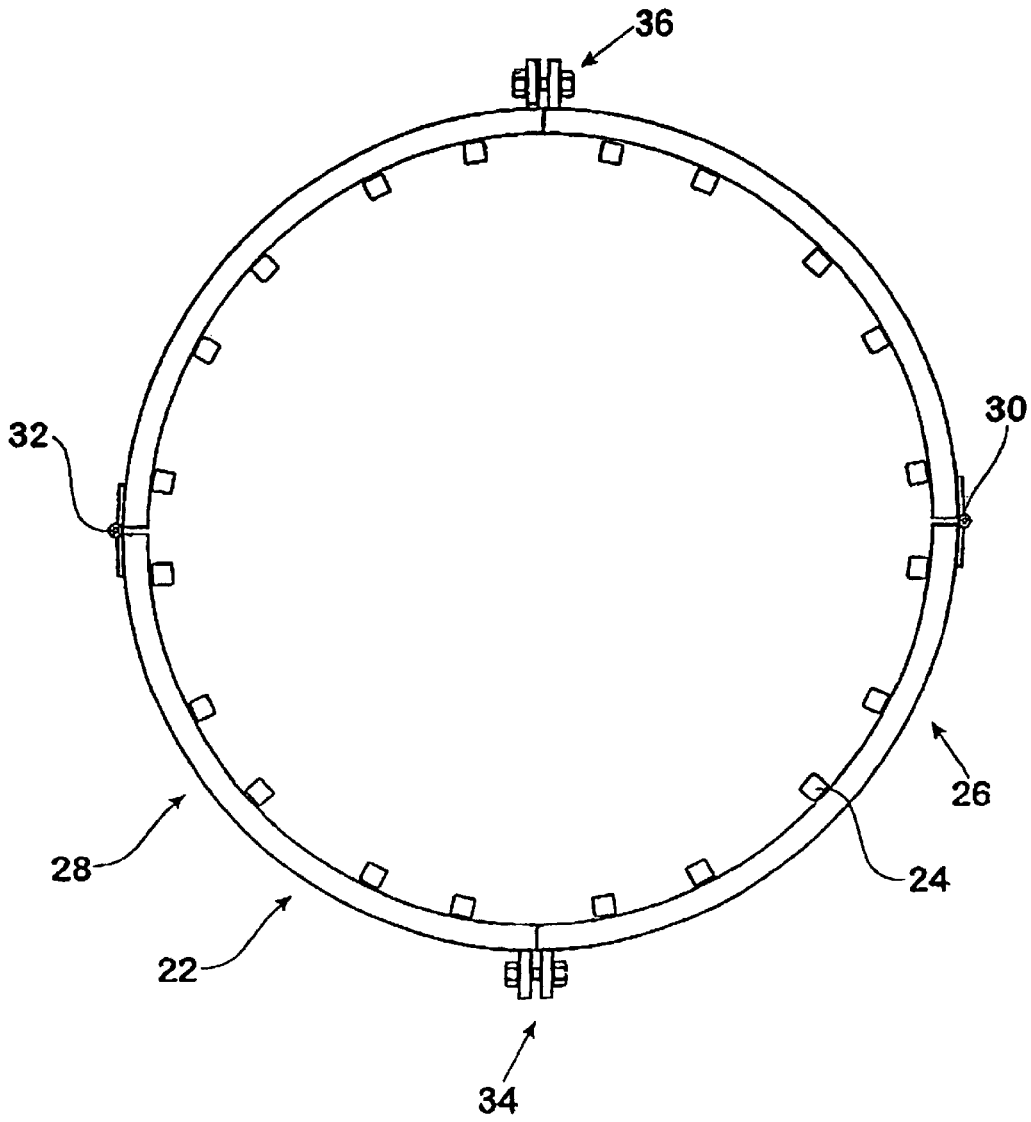
FIG. 4 is a plan view of a hoop or ring of a cage operating according to the same basic principles as that shown in FIG. 3 but with the difference that it has more longitudinal members.

At FIG. 4 there is shown a plan view of the cage 20. Each ring 22 comprises two hinged portions 26 and 28 including hinges 30 and 32. Portions 26 and 28 are bolted together at flanges 36 and 34 by means of bolts. Nineteen longitudinal members 24 comprising, for example steel rods of square cross-section, are welded or otherwise attached, for example by riveting, to the inner periphery of the rings 22. The rods 24 are spaced in order to align the blocks and wedges that will be used to construct a column. They therefore have a function of positioning the blocks relative to each other and to the rings 22. The rods 24 also act to indent the wedges.

Figure 5:
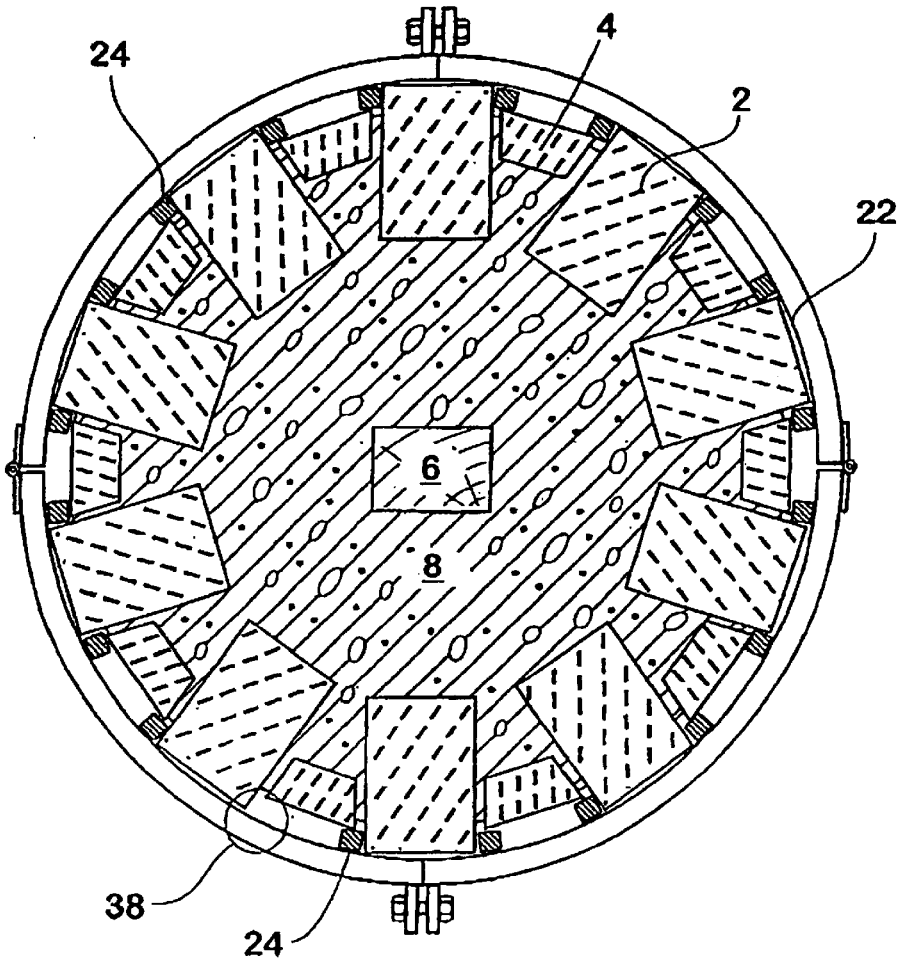
FIG. 5 is a plan view of the hoop or ring of FIG. 4 in place around a column.

With reference to FIG. 5 there is shown a plan view of cage 20 around a completed column 10. It will be noted that the inner surface of ring 22 prevents blocks 2 from falling out of the column prior to setting of the concrete 8. Other settable materials apart from concrete may also be suitable. Longitudinal members 24 act to hold blocks vertical and retain wedges 4 from falling outwards from the cage. It will be noted that a longitudinal member is omitted from the position indicated at 38. This is to make it easier for a blocklayer to insert blocks and wedges into the cage through the resulting gap, when forming the courses.

The members 24 may optionally be designed so that the ring spacing can be adjusted. This will be discussed in more detail below with reference to FIG. 10.

Referring again to FIG. 5, in use cage 20 is mounted in a position where a column 10 is to be erected such as on a base (FIG. 1). Typically internal column structural member 6 is already in place and the cage 20 is placed around the structural member by undoing either set of bolts so that the cage may be opened and placed about member 6. As previously mentioned clips or other removable fixing means may be used in place of bolts and flanges. Preferably the uppermost ring is bolted to the top of member 6 to stabilize the cage. If required, other stabilization methods are also possible, such as tethering of the cage to pegs fixed in the surrounding ground.

A first course of blocks and wedges is then formed to produce an arrangement as shown in FIG. 5. The lowermost ring 22 of cage 20 is spaced from the next ring a distance such that the upper limit of the first course is situated halfway up the wall of the second ring. Apart from the uppermost ring, subsequent rings are then spaced apart the height of a course so that each course ends halfway up the wall of the associated ring. The uppermost ring is half a ring-height closer to the ring beneath it, so that the uppermost course of blocks ends flush with the top of the uppermost ring. After arranging and mortaring the wedges 4 and blocks 2 in position, with the assistance of the rings and longitudinal members 22, 24 as positioning and retaining guides, the interior of the course is filled with concrete which acts to push the wedges 4 and blocks 2 out against the rings and retaining members 22, 24. Consequently the cage 20 facilitates the accurate and regular arrangement of the blocks and wedges in order to form a column such as that shown in FIG. 1.

Once the first course has been laid a second course is formed upon it with the guidance of a further retaining ring 22 and the longitudinal members 24. A mortar layer separates the adjacent courses. After the blocks and wedges of each layer have been mortared into place the internal void is filled with concrete. The process is continued until the column is completed.

Preferably after sufficient time has been left for the concrete and mortar to set, cage 20 is removed from the newly formed column. In order to remove the cage the bolts securing each of the two halves of each ring together are unfastened. Each half of the cage is then pivoted about the hinges of the rings thereby freeing longitudinal members 24 from the column. The two halves of the cage 20 are then removed leaving the column 10 in place.

It is convenient that a cage be formed in two hinged portions in order that longitudinal members 24 may be readily swung free of the vertical channels of the column which are formed by the offsetting of the wedges.

If it is desired to construct a very tall column then the cage may, be used to initially form a first lower stage of the column and then be raised to form a subsequent stage. This procedure avoids the necessity of having a cage of unwieldy length. Alternatively a cage of increased height or length may be provided. This can be done fairly easily by adding additional modules of cage structure to create the additional length.

Figure 1A:
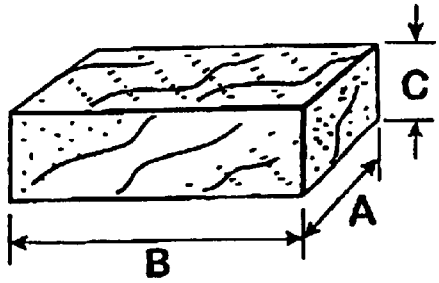
FIG. 1A is a perspective view of a block, being a brick, used in the formation of the column of FIG. 1.

Using ten standard size blocks, which, with reference to FIG. 1A have dimensions of A=110 mm, B=230 mm and C=76 mm and ten wedges a column with an outer diameter of 570 mm will result. The cage of FIG. 5 is designed for production of a such a column. It will be understood that larger numbers of blocks and wedges may be used in each course in order to produce columns with larger diameters if required. In each case a cage of suitable diameter and number of rods or spacers will be required.

It will be realised that in the embodiments of the cage discussed thus far the depth to which a building component such as wedge 4 has been indented relative to adjacent building block 2 has depended on the dimensions of longitudinal rods 24. An embodiment of the apparatus in which the distance between adjacent rings and the indentation depth is adjustable will be explained with reference to FIGS. 7 to 11.

Figure 5A:
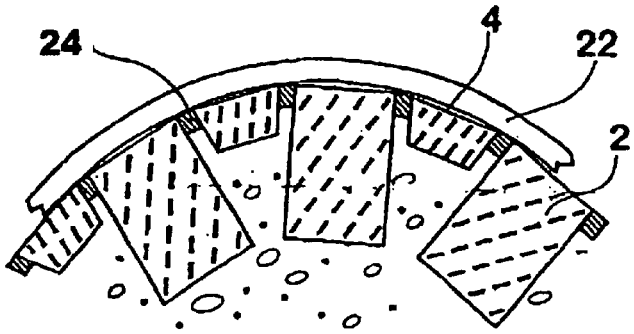
FIG. 5A is a plan view of a hoop or ring similar to that of FIG. 4 wherein the longitudinal members are of a size facilitating placement of wedges against the inner periphery of each ring.

In the event that it is desired to produce a column in which wedges 4 are not indented from blocks 2 then the rods 24 may be reduced in cross section so that wedges 4 may be placed between them and against the inner wall of ring 22. This situation is illustrated in FIG. 5A where rods with a width of 8 mm have been used. In that case mortar joints of approximately 10 mm result between adjacent wedges and blocks.

Figure 6:
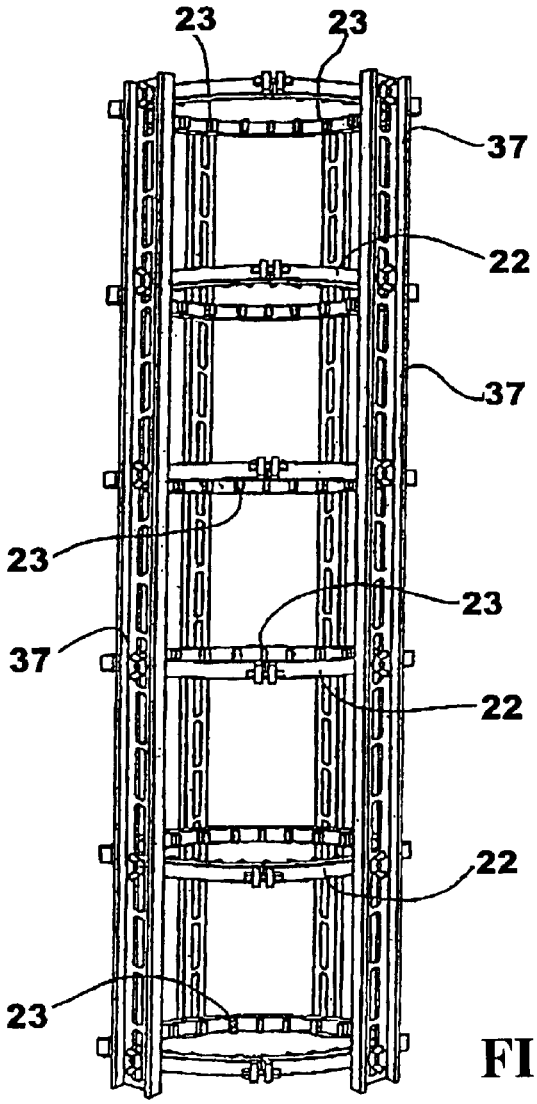
FIG. 6 is a perspective view of a cage according to a further embodiment of the invention.

A portion of an alternative construction of the cage is shown in FIG. 6. In the interests of clarity some of the hinges 30, 32 and retaining bolts and flanges 36 shown in FIG. 5 have been omitted from FIG. 6. It will be noted that indenters 23 are positioned around the inner wall of the ring 22 at the positions occupied by rods 24 in the embodiment of FIG. 3. Indenters 23 comprise short rod sections that are preferably dimensioned so that they are shorter than the height or width of the rings. By so dimensioning the rods an offset between their upper and lower limits and the upper and lower edges of the rings is produced, preferably of about 5 mm. This offset, while not essential, acts as an aid to bricklayers when positioning blocks about the rings. The rings 22 are interconnected by means of longitudinal members 37. An advantage of the cage of this embodiment is that it affords bricklayers ready access to the interior of the rings in order to facilitate easy placement of blocks and wedges during column construction.

Figure 7:
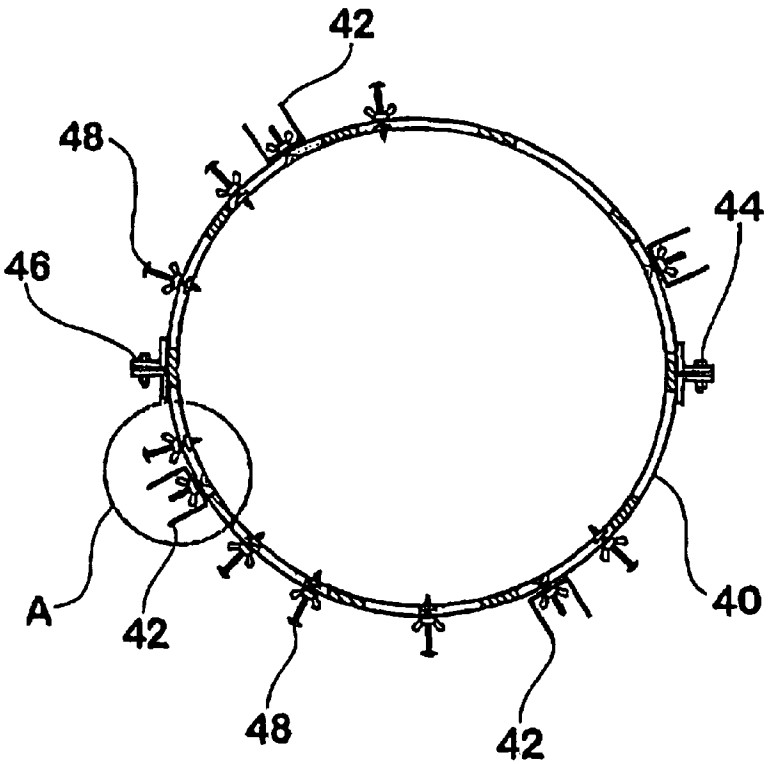
FIG. 7 is a plan view of a cage according to yet a further embodiment of the invention.
Figure 8:
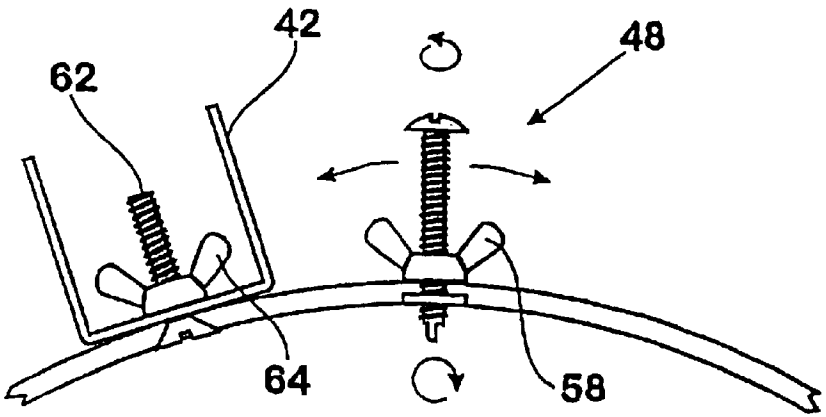
FIG. 8 is a close-up of part of the cage of FIG. 7 showing details of the attachment of longitudinal members to the ring and also indenters for indenting the blocks.

In FIGS. 7 to 11, there is depicted a plan view of a cage according to a further embodiment. The cage includes rings 40, the uppermost one of which is visible in FIG. 7. Adjacent rings 40 are interconnected by longitudinal members 42 in the form of U-channels located on the outside of the rings. FIG. 8 illustrates a close-up view of region "A" identified in FIG. 7.

Each ring 40 is made up of two identical semicircular portions which are bolted or clipped together at flange pairs 44 and 46.

Figure 11:
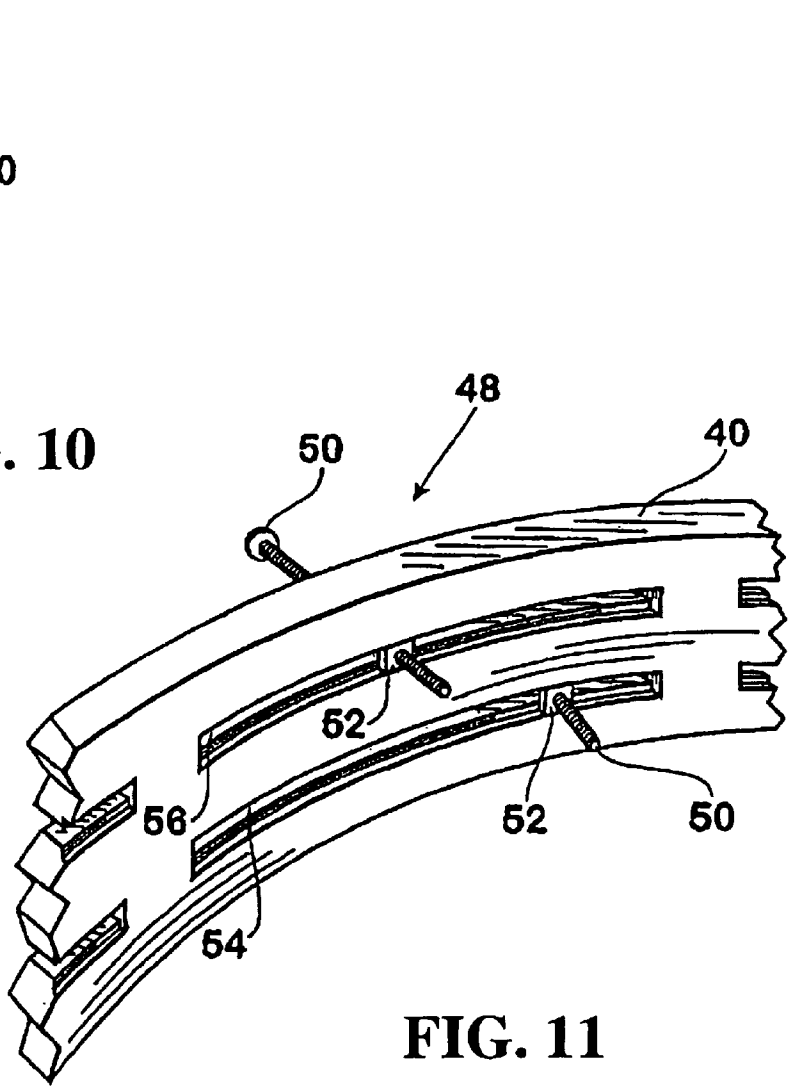
FIG. 11 is a perspective view of a portion of a ring of the cage of FIG. 7.
Figure 10:
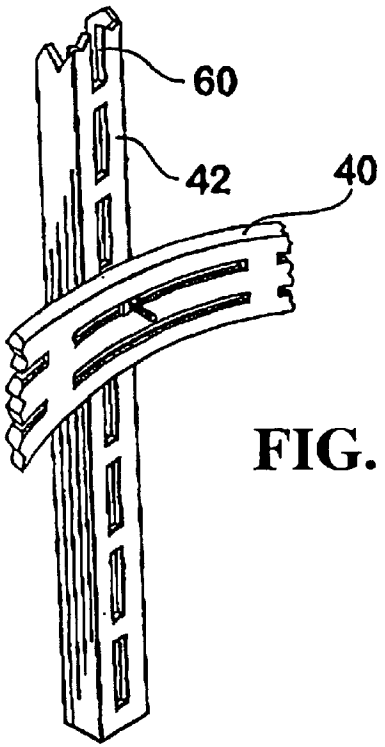
FIG. 10 is a perspective view showing detail of part of the cage of FIG. 7.

A radial portion of a ring is depicted in FIGS. 10 and 11. It will be noted that paired slots 54, 56 are present in the portion depicted. The inner wall of each slot is lipped to engage a square nut. The arrangement of slots depicted continues around the circumference of the ring. Adjustable indenters 48 are slideable about each groove. The indenters are each comprised of square nut 52, screw 50 and wing nut 58 (visible in FIG. 8). Screw 50 may be rotated to vary its depth of insertion through bolt 52. Once the desired depth is achieved the screw is locked in place by tightening wing-nut 58 against the outer surface of the ring. By providing paired grooves at different levels each with an indenter it is possible to vary the indentation of wedges of adjacent courses of a column formed with the aid of the cage.

Figure 9:
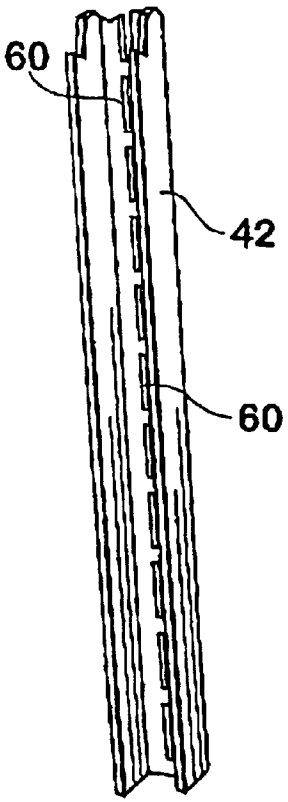
FIG. 9 is a perspective view of a longitudinal member of the cage of FIG. 7.

With reference to FIG. 9, U-channels 42 include a series of longitudinally spaced slots 60. As shown in FIG. 8, each ring is attached to the U-channels by means of bolts 62 and wing-nuts 64. The bolt heads 62 may be accommodated in the lipped slots 56, 54 so that the head of each bolt does not protrude into the circle defined by the inner circumference of the rings. Alternatively countersunk holes may be formed into the ring for bolts 62. For the purposes of stability and accuracy it is preferable that at least four equally spaced U-channels be used to space the rings as is shown in FIG. 7.

The finished column may be left with the blocks exposed as shown in FIG. 1, or may be covered with a render to produce a stonework or stucco, or other desired, finish. Finishes suitable for application to brickwork are well known in the field of building and so will not be discussed in detail here.

Figure 12:
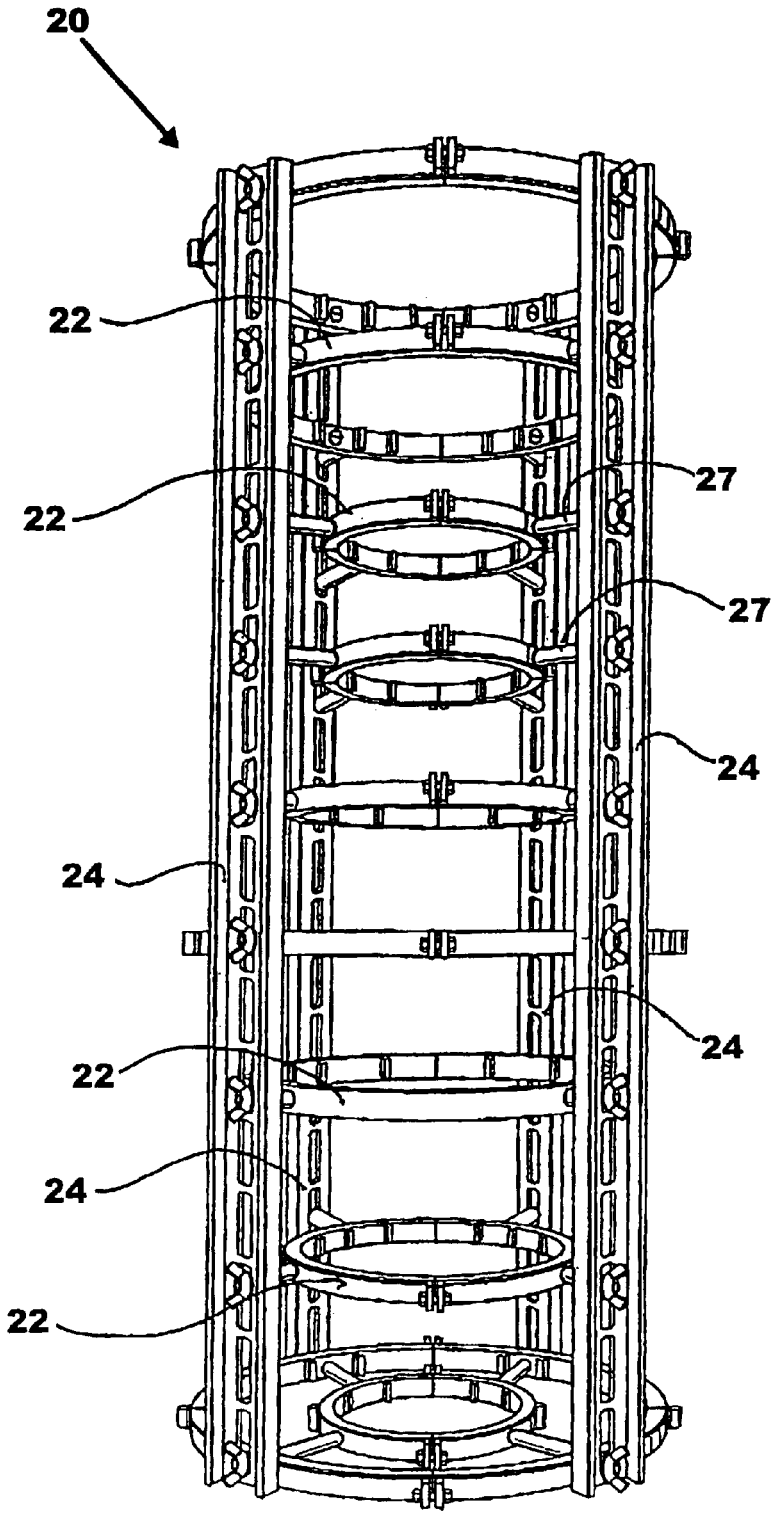
FIG. 12 is a simplified perspective view of a cage used in the production of a column of non-uniform cross-section.

FIG. 12 illustrates a cage that is adapted to make columns of non-uniform cross-section. Unless otherwise indicated the same reference numerals will be used to refer to the same components.

Typically such columns taper outwardly and then inwardly along their length with an hour glass or undulating profile. Mexican style columns in particular embody this stylisation.

The cage 20 comprises broadly a plurality of spaced longitudinal members 24. In the illustrated version there are four said members 24 spaced equidistantly apart from each other and surrounding a plurality of rings 22. The rings 22 are positioned at spaced intervals along the length of the members 24.

Different rings 22 have different diameters. As one progresses from the top of the cage in a downward direction the rings decrease in diameter up to a point three rings down where the diameter is at a minimum. Further down the cage the diameter of the rings increase in steps to a maximum diameter six rings down. The rings then decrease once more in diameter to the bottom of the cage.

Each of the rings of less than maximum diameter is held in place by support arms 27 extending radially from each longitudinal member to the associated ring 22. The support arms 27 comprise a bolt that is passed through the ring, then through a spacer spacing the longitudinal member from the ring, and then through an aperture, eg a slot aperture, in the longitudinal member. The bolt has a screw thread formation towards its free end over which a nut defining a complementary screw threaded bore, eg a wing nut, is passed. The wing nut is manually tightened onto the free end of the bolt to hold the assembly tightly and securely together.

The rings 22 of different diameter are accommodated by having bolts and spacers of different lengths. For example the third ring down from the top of the column has longer support arms than the ring immediately above it. The ring at the top of the cage has no support arms to speak of. The ring is mounted directly onto the longitudinal members 24 by means of a bolt and associated wing nut.

Figure 13:
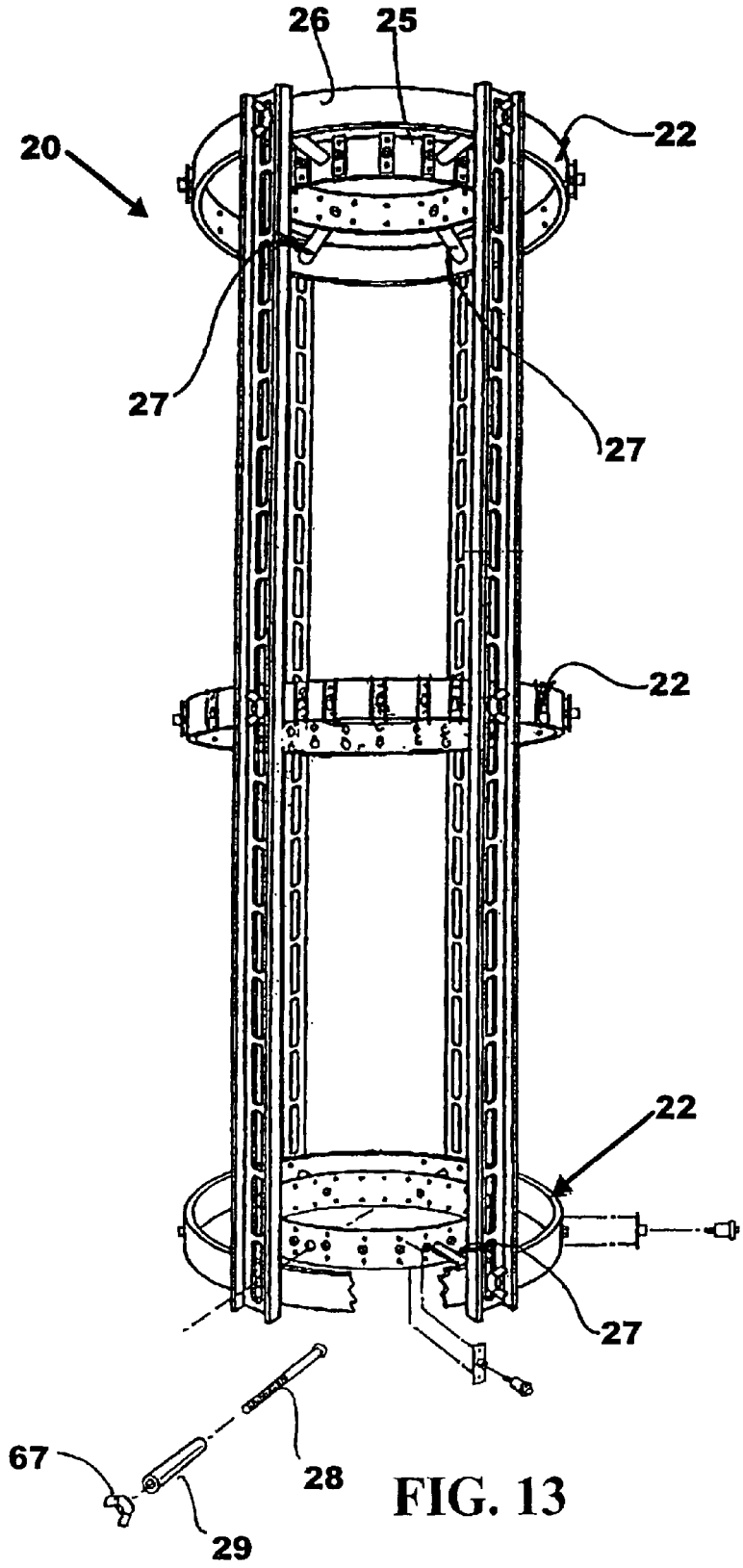
FIG. 13 is a perspective view of a column in accordance with another embodiment of the invention also for making a column of non-uniform cross-section.

FIG. 13 shows another cage having rings of different diameter forming the column of non-uniform cross-section. This cage is a variation on that shown in FIG. 12.

Broadly the cage 20 comprises three rings 22 supported by a plurality of longitudinal members 24. Most of the rings comprise an outer ring element 26 having a diameter that positions it in proximity to the longitudinal members for attachment thereto, and an inner ring element 25 spaced radially in from the outer ring element 26.

Different inner ring elements have different diameters. The diameter of the inner ring element 25 at any particular point on the column is determined by the diameter of the column design at that particular point.

Each inner ring element 25 is attached to and supported by its associated outer ring element 26 by means of a plurality of support arms 27. Each support arm is rigid and extends between the inner and outer ring elements. Generally there will be at least two said support arms 27 supporting each inner ring element 25. In the illustrated embodiment there are four said support arms 27 supporting each inner ring element 25 spaced equidistantly around the circumference of the column.

While most rings comprise an inner and outer ring element, some of the rings may comprise only a single ring element. These points correspond to the points along the column having maximum diameter. In the illustrated embodiment the middle ring is such a ring.

The support arms 27 are typically constructed such that the inner ring element 25 is detachable from the outer ring element 26.

An exploded view of the support arms 27 is shown in the drawings. It comprises a bolt 28 having a head which is passed in an outward direction through an aperture in the inner ring element 25 from the inner side thereof, then through a spacer 29 that spaces the inner and outer ring elements the correct distance apart, and then through an aperture in the outer ring element 26 and through an aperture in the longitudinal member. The free end of the bolt has a screw thread formation defined thereon and a nut 67 having a complementary screw threaded bore defined therein is passed over the free end of the bolt. Typically the nut 67 is a wing nut which can be manually tightened by an operator. This tightening urges the longitudinal member 24 onto the outer ring 22 and the other components thereby clamping all the components tightly and securely together.

When using the cages 20 illustrated in FIGS. 12 and 13, the individual blocks are tapered in a longitudinal direction along one side thereof so as to reproduce the desired tapering profile of the column. Each of the blocks that is to be used in building the column of varying cross-section is tapered or shaped before it is placed in the cage 20. This is accomplished by removing or cutting material away from one side of a blank having a rectangular block shape. Various jigs and templates can be used to assist in removing this material from the blocks to form the correct shape. One particularly preferred apparatus for achieving this task is illustrated in FIGS. 16 to 18.

Figure 16:
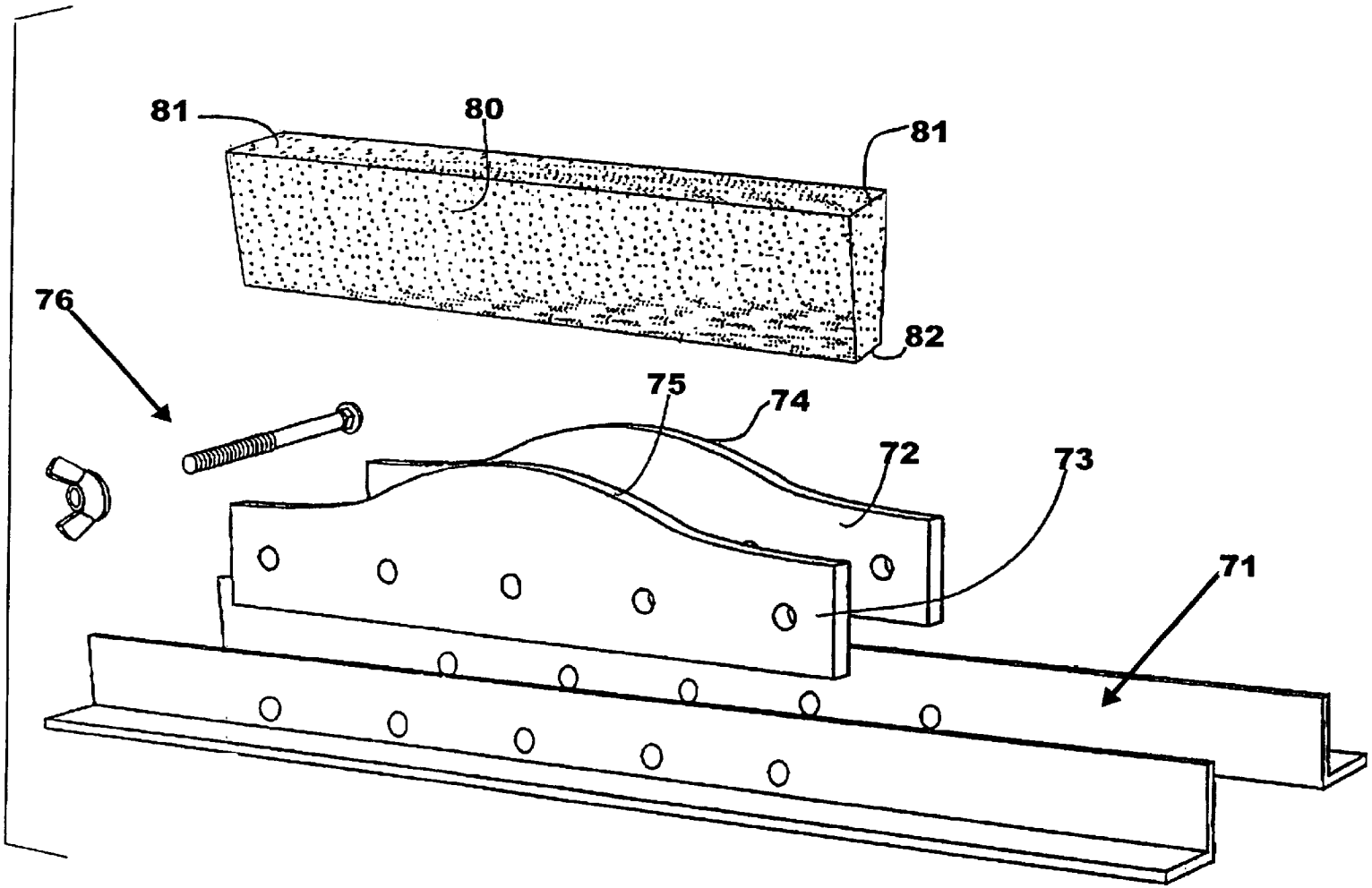
FIG. 16 is an exploded perspective view of an apparatus for shaping blocks for a tapering column prior to their insertion into the cage of FIGS. 12 and 13.
Figure 17:
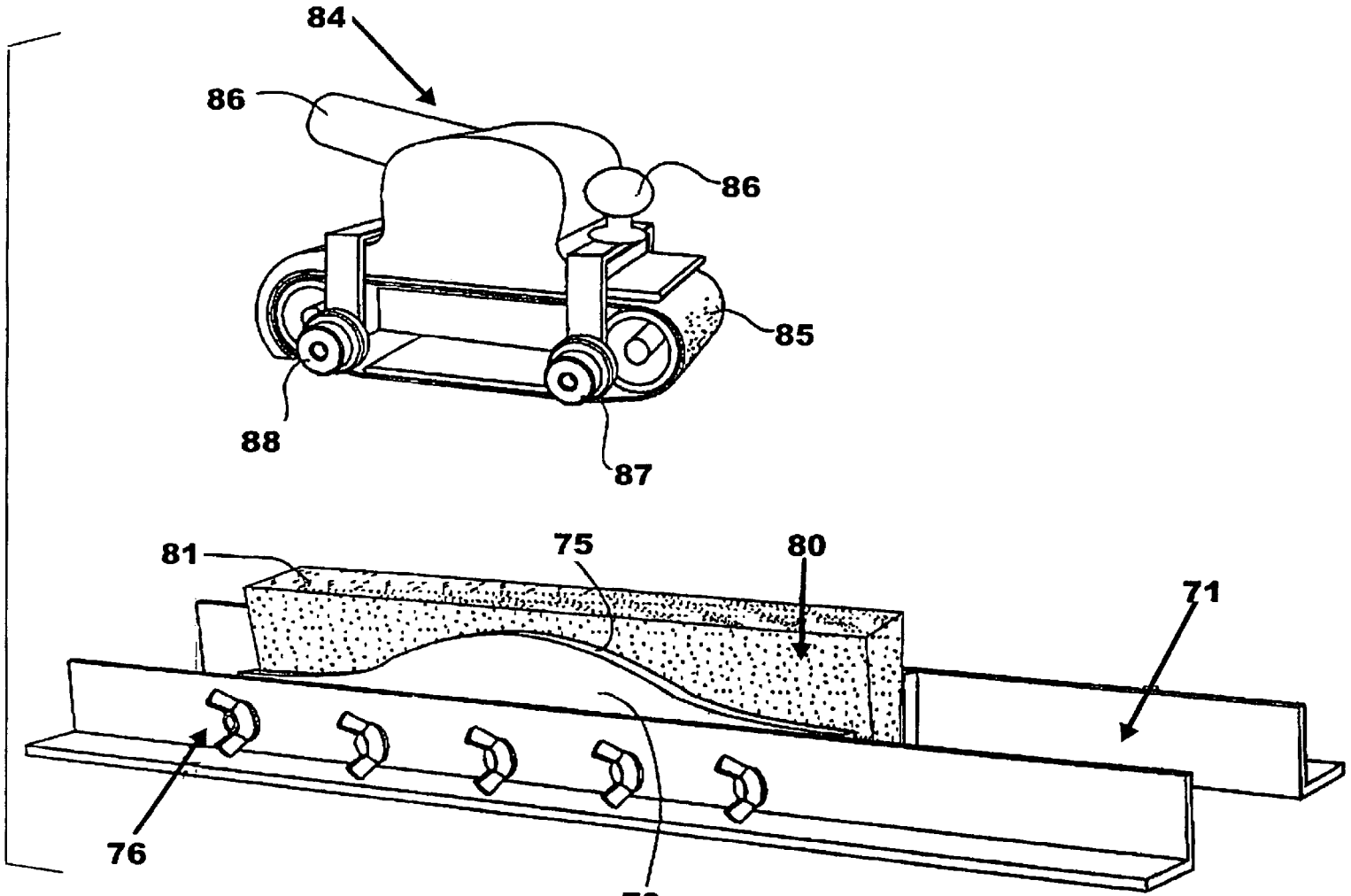
FIG. 17 is a perspective view of a block clamped into the apparatus of FIG. 16 with a sanding tool positioned above the block for removing material from the block so as to provide one side of the block with the appropriate contoured profile.
Figure 18:
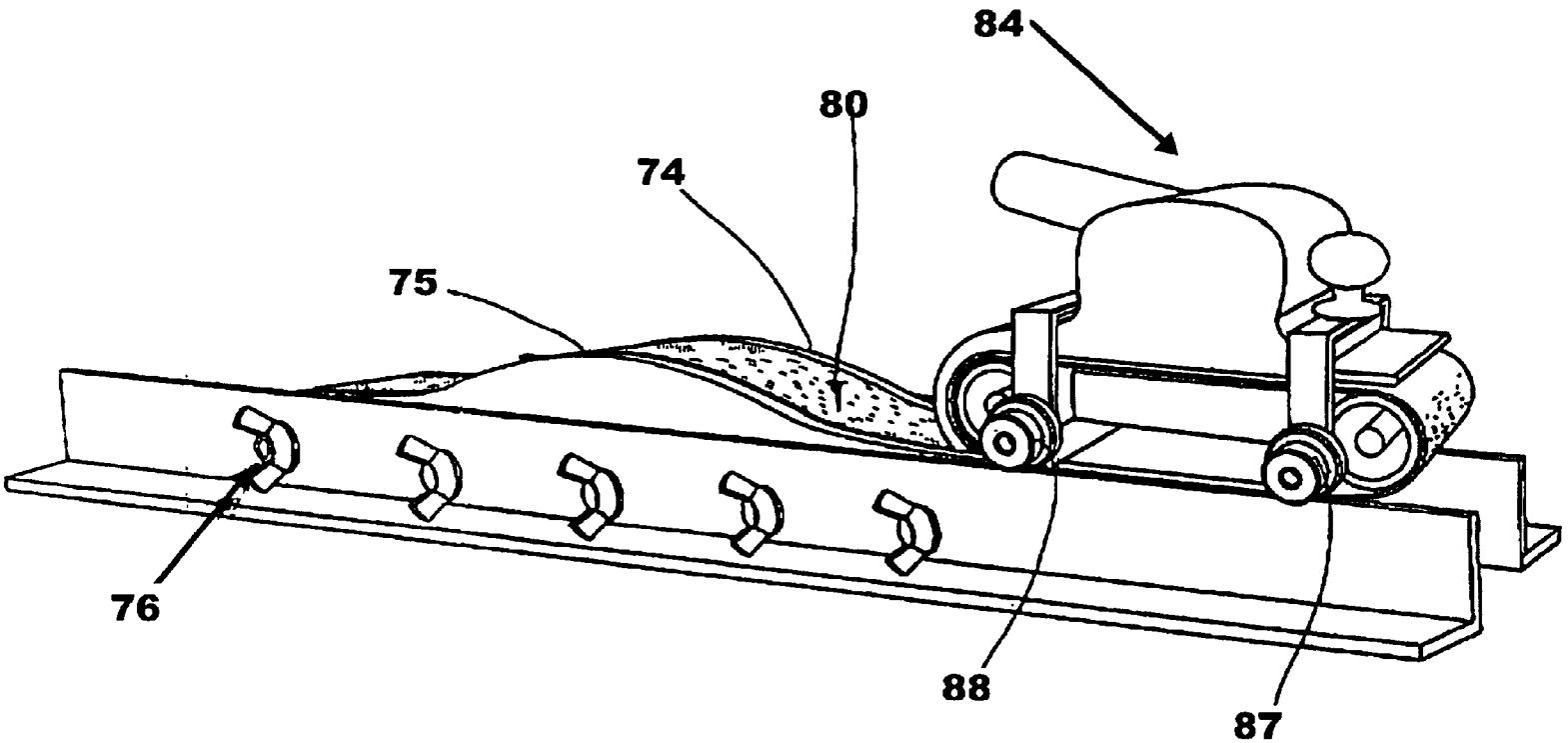
FIG. 18 is a perspective view of the apparatus of FIG. 16 showing a block that has been shaped to give a tapering profile for a column of varying cross-section.

In FIGS. 16 to 18 the apparatus generally is indicated by reference numeral 70. In FIG. 16 the apparatus 70 comprises broadly a support 71 having two members 72, 73 extending upwardly therefrom parallel to each other and spaced apart from each other. The upper edges of the members 72, 73 have a shape that defines a profile corresponding to the required taper of the block. These upper edges of the members also define rails or guide formations 74, 75 along which a cutting or sanding tool is displaced. The apparatus also includes clamping means indicated generally by numeral 76 for clamping a block indicated generally by reference numeral 80 firmly between the two members 72, 73 and clamping the members 72, 73 to each other to form a single assembly. In the illustrated embodiment the clamp comprises a plurality of screw threaded bolts over which manually rotatable wing nuts are passed.

The block 80 illustrated in the drawings is an elongate block that is typically made of HEBEL. Typically the block will have a length of 1.2 meters. Further the block 80 has a trapezoidal shape in cross-section which may loosely be described as a wedge. One side of the block namely the outer side 81 is wider than the inner side 82 which is an inner side. The block 80 as a whole has a constant cross-section along its length.

Figure 19:
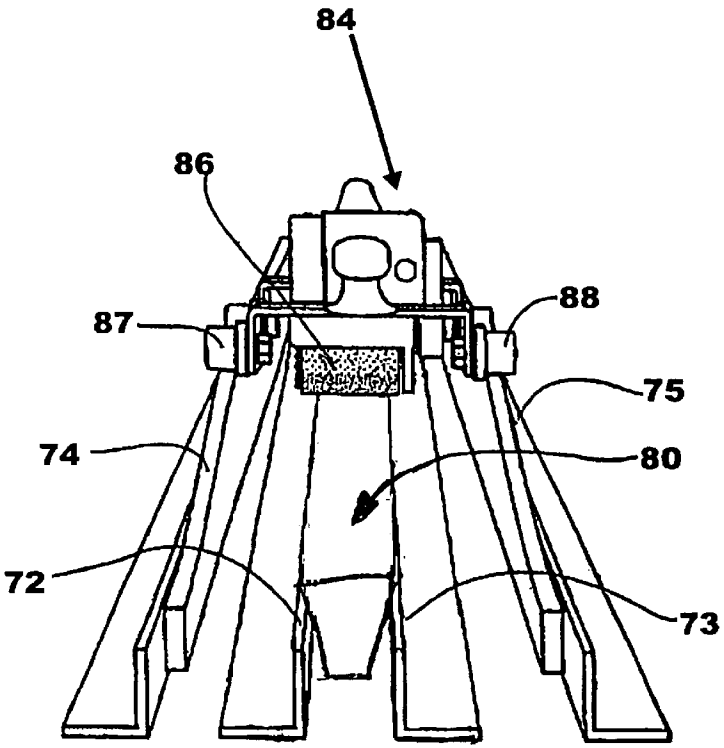
FIG. 19 is a perspective view from one end of a block and apparatus similar to that in FIG. 16.

FIG. 17 shows the block 80 tightly clamped between the members 72, 73. While the apparatus in FIG. 19 is different it shows how the wedge shaped block may be clamped in the apparatus between members 72, 73. It also shows a sanding tool 84 for removing excess material on said outer side 81 of the block 80 projecting up above the upper edges or rails 74, 75 of the members 72, 73. The sanding tool 84 may conveniently be a sanding tool of the type that is bought off the shelf. It comprises a sanding element 85 which is moved at high speed and which is brought into contact with the surface to be sanded and two handle formations 86.

The tool 84 does however have one modification to adapt it for use with the apparatus described above. The modification comprises the addition of two front wheels 87 and two rear wheels 88 spaced longitudinally apart from each other on the tool. The front and rear wheels 87 and 88 travel along the rails 74, 75 formed by the upper edges of the members 72, 73. This travel of the wheels 87, 88 along the rails 74, 75 guides the sanding tool 85 along a complementary path and shapes the profile of the block in the desired form.

In use the sanding tool 84 is energised and is then passed over the outer end 81 of the block 80 so that, at least when the block 80 is worn down, the wheels 87, 88 travel along the rails 74, 75. This removes excess material from the block 80 and produces a block 80 having the desired profile. The travel of the wheels 87, 88 along the rails provides a system for reliably and reproducibly producing the desired profile in the block to the required tolerances The tool 84 is manually pushed along the rails by an operator gripping the tool 84 by the handles 86 provided for this purpose.

FIG. 18 shows how the outer side 81 of the block 80 has been shaped appropriately to conform with the profile defined by the upper edges or rails 74, 75 of the members 72, 73. This apparatus therefore provides an efficient and reliable way of accurately shaping all of the blocks 80 to be used in the column with the correct shape.

FIG. 19 shows a variation on the apparatus shown in FIGS. 16 to 18. The block 80 is clamped between the rails 72, 73 and the rails 74, 75 are formed by a pair of members spaced outwardly of the members 72, 73. In this version the wheels travel along the rails that are spaced outwardly of the block. FIG. 19 also shows how the wedge of the trapezoidal cross-section is clamped in position between the parallel extending members 72, 73.

Figure 1B:
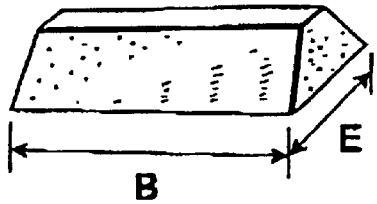
FIG. 1B is a perspective view of a further block, being a wedge, used in the formation of the column of FIG. 1.

Applicant also points out that the blocks used in FIGS. 16 to 18 are considerably longer than the blocks used in the column of FIG. 1 and illustrated in FIGS. 1*a* and 1*b*. The blocks in these drawings would have a length at least three times that of the blocks illustrated in FIG. 1 The blocks 80 illustrated in FIG. 16 typically have a length of about 1.2 meters. An obvious advantage of using longer blocks is that the number of courses provided to produce a column of given height is reduced and therefore the manual labour involved in producing a column is substantially reduced.

Applicant has found that HEBEL is a convenient material to use in the formation of the columns, HEBEL is a building material that can be supplied in sections having a suitable square rectangular cross-sectional profile. The blocks are then cut by a saw to produce a wedge shaped cross-section as shown in FIG. 16. The sections are provided in lengths of 2.4 meters. These are cut into two blocks each having a length of 1.2 meters.

The apparatus can be used to cut blocks for a large variety of columns having different profiles. A block 80 having a different profile may be cut by simply removing the members 72, 73 shown in the drawings and replacing them with new members having a different profile. In fact the apparatus may include a number of sets of members 72, 73 each having different profiles corresponding to different designs of columns of varying cross-section. The operator then selects the set of members having the appropriate contour or shape for the particular design to be built and mounts these on the support 71. The blocks are then cut in the manner described above.

Figure 14A:
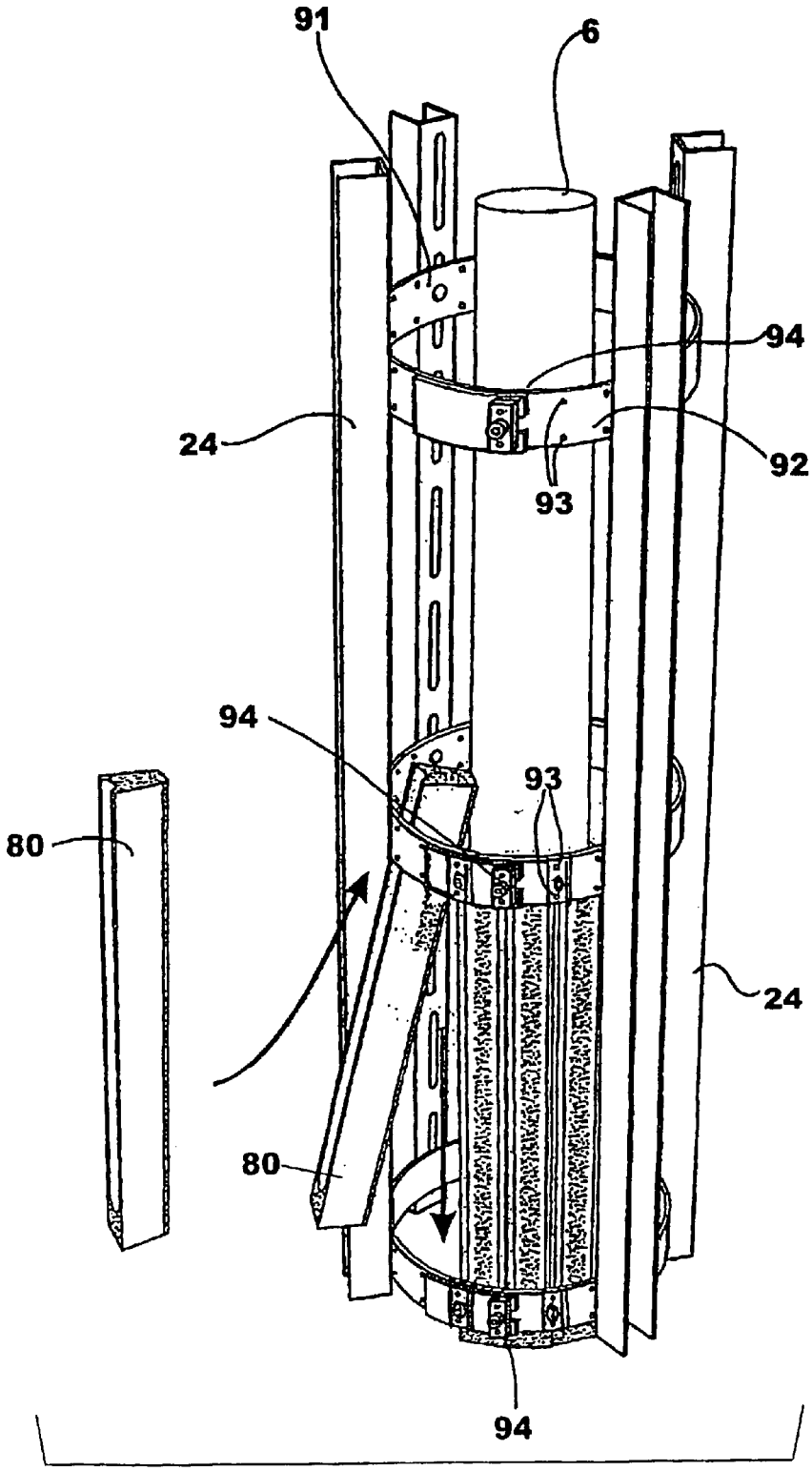
FIGS. 14A and 14B are perspective views of another embodiment of a cage for making a column of constant cross-section along its length with some detail omitted for clarity.
Figure 14B:
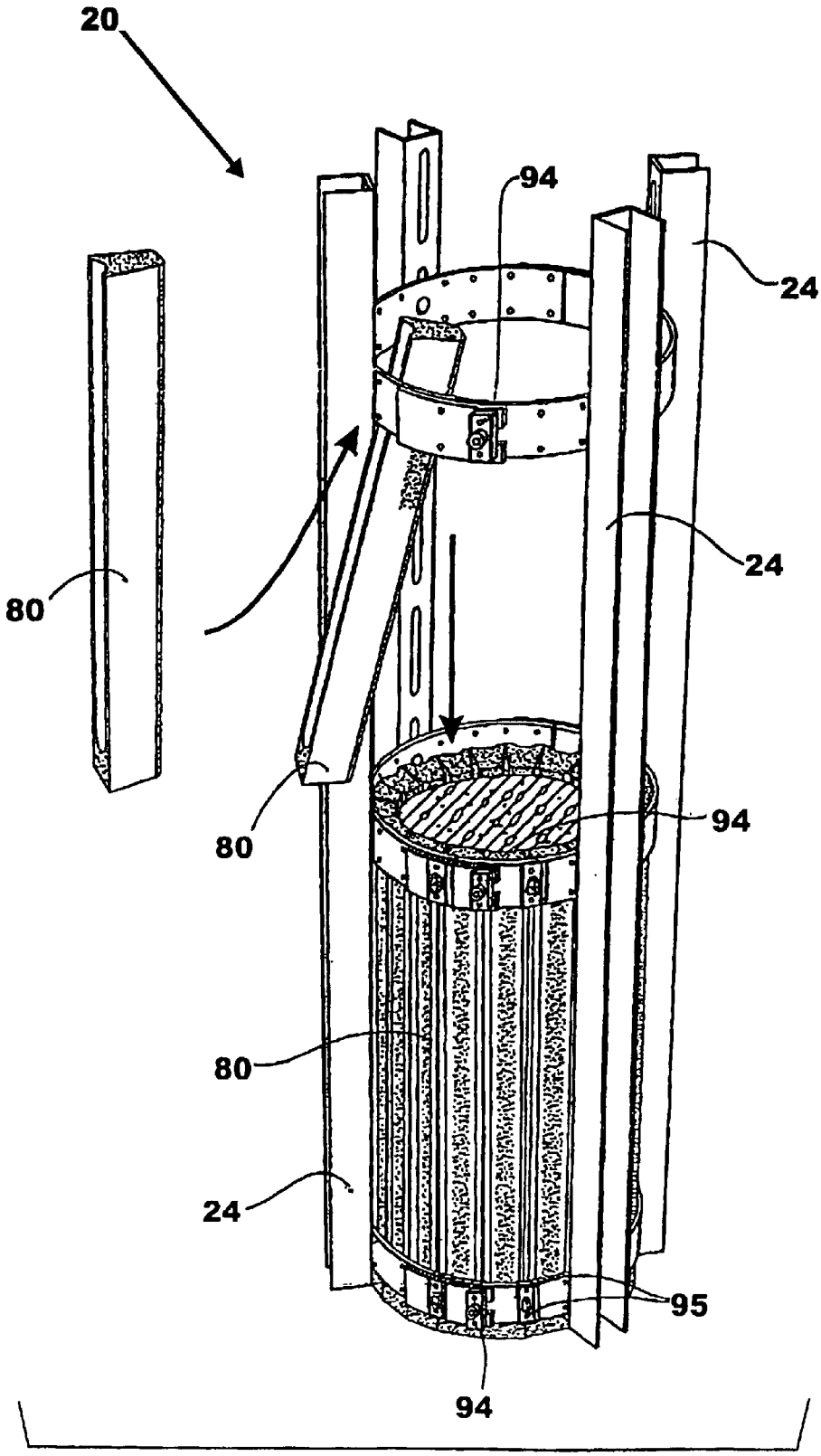

FIGS. 14A and 14B show yet another cage suitable for producing a column of constant cross-section. This column is structurally and functionally very similar to the column illustrated in FIG. 3. Accordingly the following description will focus on the features of this column that are different to that of the column in FIG. 3.

The cage broadly comprises a set of four longitudinal members 24 spaced apart from each other around the circumference of the column that are interconnected by a plurality of transverse retaining members 22. In the illustrated embodiment there are three said retaining members 22 which are rings spaced apart from each other. One is positioned towards the top of the column, one towards the bottom of the column, and an intermediate ring is positioned mid way up the height of the column.

Each longitudinal member 24 comprises a U-shaped channel section opening outwardly and having a web portion that is attached to the rings or retaining members 22. Each member has a plurality of apertures, eg slot apertures, defined therein through which one or more bolts can be passed to attach the longitudinal members 24 to the rings 22.

Each ring 22 comprises two half circle ring elements 91, 92 which overlap each other at each end and are attached to each other via the overlapping ends. Each ring element 91, 92 has a plurality of pairs of apertures 93 defined therein at spaced intervals around its circumference.

Figure 15:
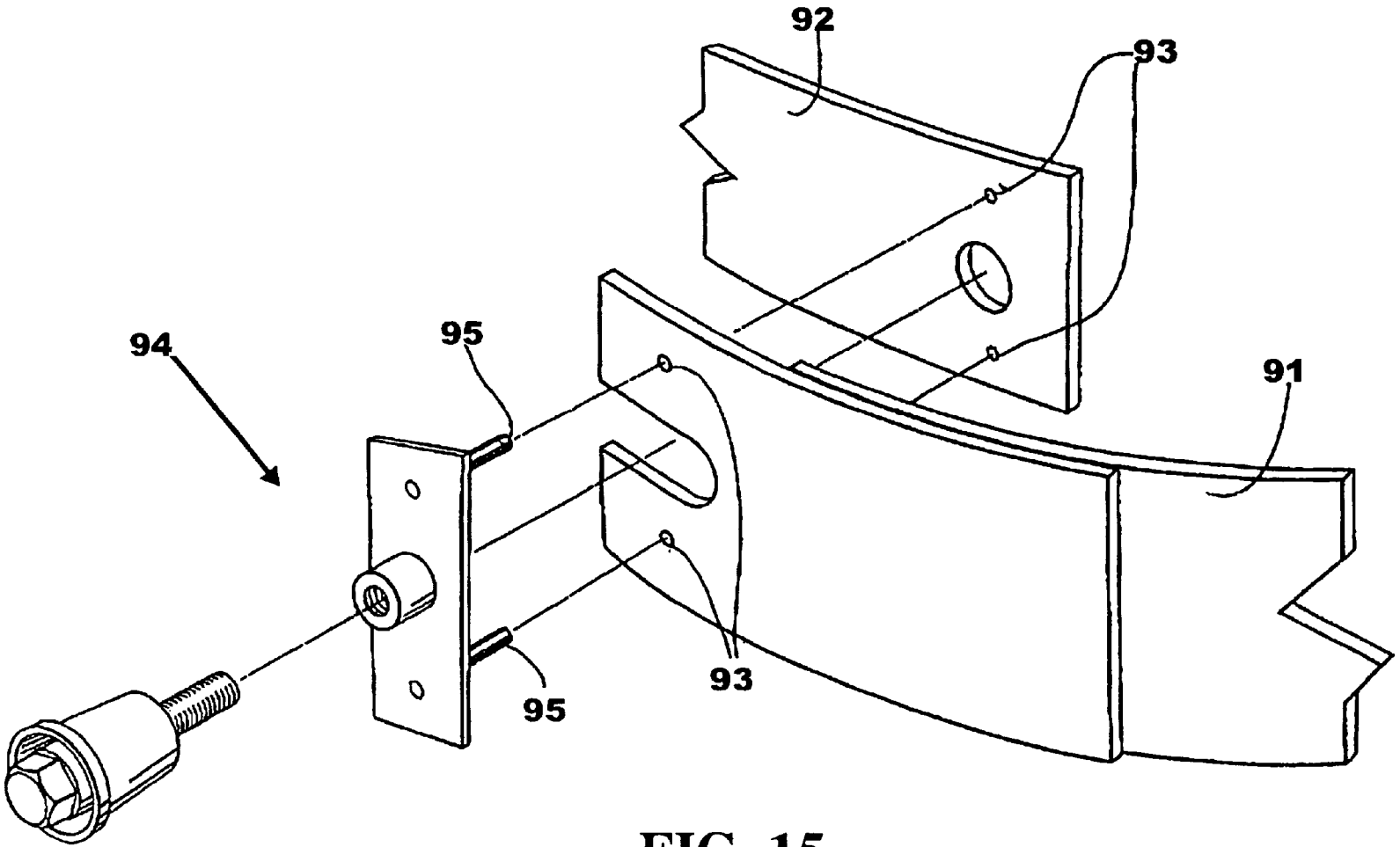
FIG. 15 is a perspective view showing part of a ring of the cage of FIG. 14.

As illustrated in some detail in FIG. 15 the overlapping ends of the elements 91, 92 are attached to each other by passing a locating element 94 having pins 95 through the pairs of apertures which are aligned in both elements to attach them together. This attachment mechanism is in some respects analogous to the attachment of ends of a belt. The pairs of apertures 93 on the two elements 91, 92 are aligned and then the pins are passed through both elements 91, 92 to attach them together.

Further locating elements 94 with pins 95 are also passed through the remaining apertures in the ring element. The pins 95 project through the ring elements 91, 92 into the space defined by the rings 22 and correctly position the blocks 80 within the cage 20. Each block 80 is positioned with such a pin 95 on either side thereof in the space between the block and the adjacent block. This way the blocks 80 are accurately positioned on the column to form a precise and symmetrical column.

The pins 95 of the locating elements 94 that attach the two ring elements 91, 92 to each other also perform this function of locating and aligning the individual blocks within the column, Therefore these particular elements 94 perform two functions, namely attaching the two elements to each other and locating the blocks with respect to each other and the cage.

In FIGS. 14A and 14B the pole or member around which and onto which the column is built has deliberately not been shown with full detail to keep the illustration as simple as possible.

In use the cage is constructed by attaching two longitudinal members 24 to three ring elements 91, 92 to form a half cage. Two half cages are then attached to each other by passing the pins 95 of the locating elements 94 through the overlapping ends of the ring elements 91, 92 as described above. This attachment is illustrated in some detail in FIG. 15. This produces an assembled cage ready for use in forming a column. The cage is mounted around the pole or elongate member that is not shown in detail in the illustration.

The column construction process is commenced by placing blocks 80 sequentially into the column to form a lower course of blocks extending between the bottom ring and the intermediate ring. Each block is placed carefully in position with the pins of the adjacent locating elements on either side thereof. The space between the adjacent blocks is filled with a settable material, eg mortar. Once the first course has been built up the interior space defined by the blocks is filed with a settable material, eg concrete, to form a solid column.

In FIG. 14 some of the blocks have longitudinal grooves in their outer surfaces, These provide fluting on the outer surface of the column which is an optional aesthetic feature.

As shown in FIG. 14B the process is then repeated for a second course of blocks.

In the illustrated embodiment each block has a length of 1.2 meters and the column that is built has a height of 2.4 meters. If additional height is required for the column to be erected then a cage of increased height is provided and a column having more courses is built up in the same way as described above.

An advantage of the method and apparatus described above is that the components forming the cage is very simple and can be easily transported to a building site and then assembled on site. The cage is assembled with a length that corresponds to the height of the column to be built. The column can then be manufactured on site and used to form an integral column of a building. This way the formed column does not need to be transported to the actual building site. This avoids the complexity and attrition that one would expect in transporting such a column over large distances. Despite the simple manufacturing procedure that is carried out on the site a finely engineered column having close tolerances is produced and that will satisfy the most discerning customer. Yet further the method and apparatus provides a flexibility in column height. The cage is formed with the appropriate length on site and a column having this height is then built The column is simply built to the desired height whatever that may be This is simply not possible with precast products.

Further the column illustrated in FIG. 14B comprises only two courses of blocks and as such can be manufactured fairly rapidly using a minimal amount of labour. The advantages of the reduction in labour cost using blocks of the size illustrated in FIG. 14 are obvious.

While the cages described above have been of circular cross-section it is also possible to produce cages having square rings in order to form columns of square cross section. Square cross section columns do not require the incorporation of wedges but only of regular blocks. Polygonal rings may also be used in order to produce columns of polygonal cross-section.

It will of course be realised that the above has been given only by way of illustrative example of the invention and that all such modifications and variations thereto as would be apparent to persons skilled in the art are deemed to fall within the broad scope and ambit of the invention as is herein set forth.

What is claimed is:

1. A method of forming a column for use in a building structure, the method including:

providing an apparatus for use in forming a column from a plurality of courses of blocks, the apparatus including a plurality of elongate members adapted to extend longitudinally with respect to the column and adapted to be spaced apart from each other around the column; a plurality of retaining members extending transverse to the elongate members and mounted thereto, the retaining members adapted to be spaced apart from each other by not more than the length of the blocks such that there is at least one retaining member for each course of blocks, the retaining members adapted to assist in vertically aligning and positioning the blocks; and indenters for indenting or setting a block radially inwardly from an adjacent block and also from an associated retaining member so as to create a column with longitudinal grooves or indentations, and wherein the radial position of an indenter can be adjusted so as to vary an offset depth of an indented block;

providing a plurality of courses of blocks;

positioning the apparatus where the column is to be formed;

laying one or more of the courses of blocks in the form of a closed figure forming a peripheral surface of the column and defining an interior space radially inwardly of the blocks, the blocks being located by the retaining members of the column forming apparatus; and filling the interior space with a settable material and allowing it to set.

2. The method according to claim 1, wherein the laying step includes adhering the blocks to each other by mortaring them to each other with a cementitious material and the settable material that is used to fill the interior space is also a cementitious material.

3. The method according to claim 1, wherein the positioning step comprises locating the apparatus around an axial support member, and rigidly mounting the apparatus to the axial member by means of a stabiliser extending between the apparatus and the support member.

4. The method according to claim 3, wherein the longitudinal members and retaining form a cage that can be opened and closed along an axis extending in a longitudinal direction, and the step of positioning the apparatus includes either opening up the cage or else lowering it over the axially extending support member.

5. The method according to claim 4, further including the step of separating the cage from its attachment to the support member by removing the stabiliser and then opening up the cage and moving it out from its position surrounding the column.

6. The method according to claim 1, wherein said column has a plurality of courses of blocks and the method comprises laying a first course of blocks then filling the interior space of the first course with a settable material, and then repeating this procedure of laying the course and filling the interior space for succeeding courses of blocks until a column of desired height has been formed.

7. A combination comprising:

a column comprising a plurality of vertically stacked courses of blocks, each course comprising a plurality of blocks that are arranged in horizontal alignment with each other and in the form of a closed figure defining an interior space radially inward of the blocks, and wherein the blocks are adhered to each other by a settable material which is also used to fill in the interior space; and an apparatus for forming the column comprising:

a plurality of elongate members extending longitudinally with respect to the column and adapted to be spaced apart from each other around the column; and a plurality of retaining members extending transverse to the elongate members and mounted thereto, the retaining members spaced apart from each other by not more than a length of the blocks such that there is at least one retaining member for each course of blocks, the retaining members assisting in vertically aligning and positioning the blocks in an adjacent course and also holding the blocks in place while the column is being built.

8. The combination according to claim 7, wherein the plurality of retaining members comprises top and bottom retaining members and also at least one intermediate retaining member positioned between said top and bottom retaining members, and the top retaining member is positioned to overlie a top comic of blocks and the bottom retaining member in positioned to overlie a bottom course of blocks, and at least one intermediate retaining member is positioned to overlie a said point of separation of two adjacent courses of blocks.

9. The combination according to claim 7, further including slide formations on the elongate members for permitting the retaining members to slide longitudinally on the elongate members at least to some extent, so as to permit the retaining members to be positioned straddling a point of separation of the adjacent courses of blocks.

10. The combination according to claim 7, further comprising:

slide formations on elongate members for permitting the retaining members to slide longitudinally on the elongate members, wherein each slide formation is formed by each elongate member having a slot aperture, and the retaining members are mounted to the elongate members by a bolt passed through an aperture in the retaining member and then through the slot aperture in the elongate member, and a fastening nut passed over the free end of the bolt whereby loosening of the nut permits relative movement of the retaining member and the elongate member.

11. The combiantion according to claim 7, wherein at least one of the retaining members is vertically positioned so as to straddle a point of separation of adjacent courses of blocks intermediate the ends of the column thereby to assist in the vertical alignment of the course of blocks above the point of separation said and the course of blocks below the point of separation.

12. The combination according to claim 7, further including locaters on each retaining member for laterally locating the position of each block with each associated course of blocks.

13. The combination according to claim 12, wherein each locater projects into a space between adjacent blocks in the course of blocks, thereby to laterally position the blocks on either side of said space.

14. The combination according to claim 13, wherein each locater comprises a pin that is removably inserted through each retaining member in a radially inward direction and into each said space between adjacent blocks and each said retaining member has said pins extending into each said space between adjacent blocks in the course to correctly position all the blocks in the course.

15. The combination according to claim 7, further including indenters for indenting or setting a block radially inwardly from an adjacent block and also from the associated retaining member so as to create a column with longitudinal grooves or indentations.

16. The combination according to claim 15, wherein the radial position of the indenters can be adjusted so as to vary an offset depth of an indented block.

17. The combination according to claim 7, wherein the retaining members are in the form of rings each having a substantially circular configuration and the elongate members and retaining members together form a cage.

18. The combination according to claim 17, having an intermediate retaining member overlying each point of separation of adjacent courses of blocks up the height of the column whereby to align and position the blocks of all the courses in the column.

* * * * *